US005115981A

United States Patent [19]

Callahan et al.

[11] Patent Number: 5,115,981

[45] Date of Patent: May 26, 1992

[54] ATOMIZER FOR COMPRESSIBLE CONTAINERS

[76] Inventors: George E. Callahan, Feldstrasse 34, D-4000 Dusseldorf 30; Harald Koch, Irmgardstrasse 22, D-4000 Dusseldorf 1, both of Fed. Rep. of Germany

[21] Appl. No.: 660,212

[22] Filed: Apr. 23, 1990

Related U.S. Application Data

[63] Continuation of Ser. No. 333,729, Apr. 3, 1989, abandoned, which is a continuation of Ser. No. 897,787, Aug. 19, 1986, abandoned.

[30] Foreign Application Priority Data

Sep. 2, 1985 [CH] Switzerland ..... 3765/851

[51] Int. Cl.[5] ..... B05B 1/34; B05B 7/24

[52] U.S. Cl. ..... 239/402; 239/405; 239/466; 239/468

[58] Field of Search ..... 239/327, 399, 402–405, 239/434.5, 491, 492, 466, 468; 222/485

[56] References Cited

U.S. PATENT DOCUMENTS 2,574,865 11/1951 Edwards .
3,392,886 7/1968 Albert et al. .
3,583,602 6/1971 Gruber et al. ..... 239/327 X
4,186,882 2/1980 Szczepanski ..... 239/327
4,356,941 11/1982 McRoskey et al. .

FOREIGN PATENT DOCUMENTS 2411637 8/1979 France ..... 239/327
48369 6/1966 German Democratic Rep. ..... 239/327
249364 6/1947 Switzerland .
187015 10/1922 United Kingdom ..... 239/402

*Primary Examiner*—Andres Kashnikow
*Attorney, Agent, or Firm*—Shoemaker and Mattare, Ltd.

[57] ABSTRACT

When the container is compressed, liquid flows via a riser (2) and an inflow channel (10) tangentially into a vortex chamber (9), where a rotary flow is induced. The liquid is accelerated by the conical cross-section of the inner wall (5) of the liquid nozzle (1) until it is discharged from the orifice (7) of the liquid nozzle (1). At the same time, air from the container flows via an inflow channel (11) into the annular chamber (3) which surrounds the liquid nozzle (1). Coaxial with the liquid nozzle there is a mixture nozzle (4) with a conical inner wall (5'). The orifice (7) of the liquid nozzle (1) is retracted relative to the orifice (8) of the mixture nozzle (4), so that the two media are jointly accelerated after mixing.

2 Claims, 2 Drawing Sheets

ATOMIZER FOR COMPRESSIBLE CONTAINERS

Figure 1:
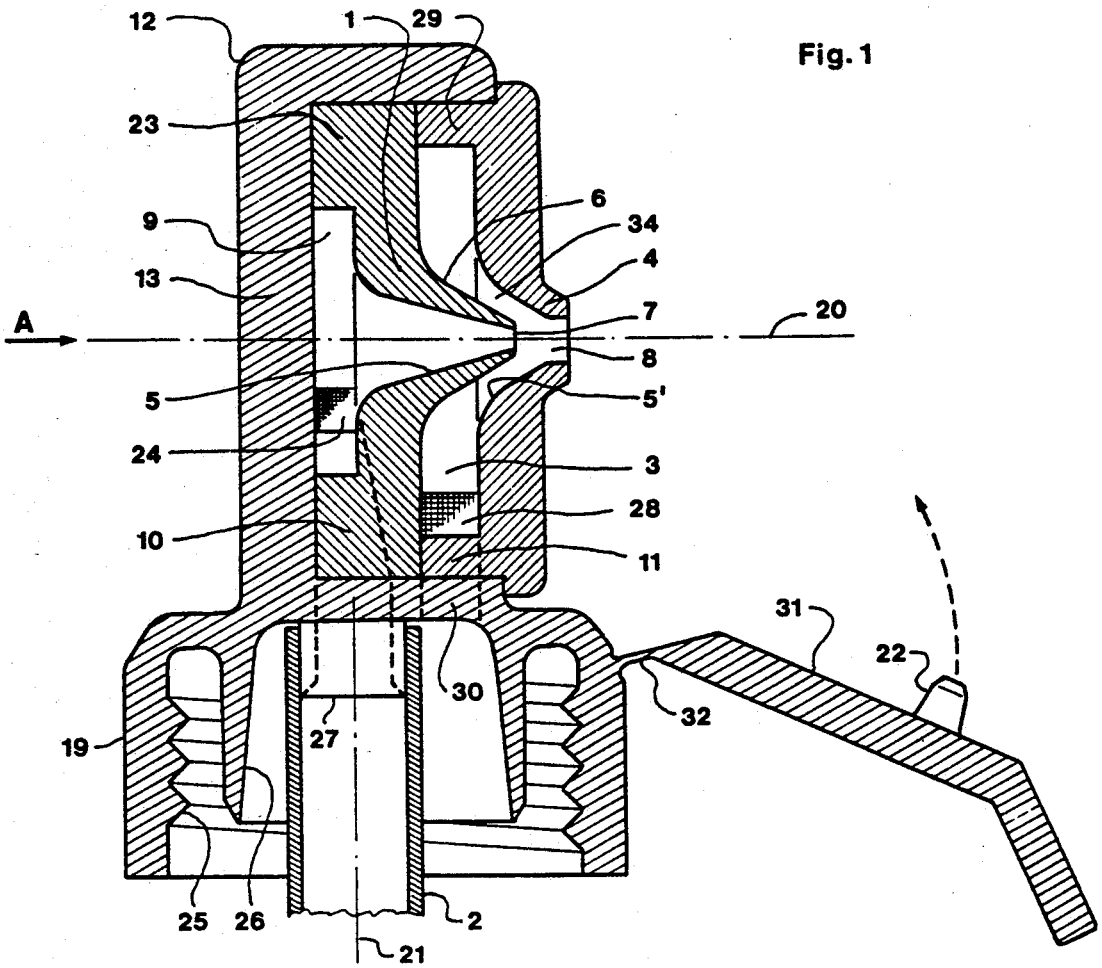

This is a continuation of application Ser. No. 333,729 filed Apr. 3, 1989now abandoned, which in turn is a continuation of application Ser. No. 897,787 filed Aug. 19, 1986, now abandoned.

This invention concerns an atomizer suitable for use with a compressible container for dispensing liquids in aerosol or spray form. Such devices are generally known and in common use. They are often attached to disposable plastic containers, and thrown away together with the container when the latter is empty.

The best fine atomizers are double-piston aerosol pumps with a spring-operated valve that releases the liquid only when the overpressure exceeds approximately 5 bars. However, if the amount of liquid to be atomized is more than 0.2 ml per stroke, the aerosol will be appreciably coarser, since otherwise the pressure required would make manual actuation difficult.

With simpler single-piston pumps, complete drop-free atomization cannot be guaranteed, and the fineness of the aerosol is largely dependent on the pressure applied. Because the pump is actuated with a lever, amounts of up to 1 ml per stroke can be expelled manually.

Piston pumps are relatively complicated, since they consist of several moving parts. An atomizer which is actuated by pressing the container can be much simpler in construction.

One problem in the latter device is the difficulty of achieving uniformly fine atomization, since the average overpressure in the container amounts to less than 0.3 bars. This results from the fact that air must likewise flow out of the container if the liquid is to be atomized. Since the air is expelled form the container very quickly, the overpressure is also variable, and lasts of short duration, so that a limited amount of liquid is only coarsely atomized. In known devices, an attempt has been made to improve atomization by mixing the liquid with air in a mixture chamber with turbulent flow, before they are expelled through the common mixture nozzle. Thus, e.g. DE-B-1 059 363 shows an atomizer for plastic bottles, in which a tube connection serving as a liquid nozzle extends into a mixture chamber. Air enters the mixture chamber through holes, and the liquid/air mixture leaves the mixture chamber through a spray nozzle located on the same axis as the tube connection.

A similar construction, in which the liquid nozzle and the mixture nozzle are combined to form a closure element, is disclosed in DE-A-28 07 204. Here the nozzles are opened only when the interior pressure has reached a certain level. Mixing also takes place by means of turbulent flow. However, this necessary turbulence impairs performance because the resulting impulse loss is large relative to the limited overpressure that can be attained manually.

The purpose of the invention is to provide a spray device with no moving parts that, using the low and irregular overpressure obtainable with a compressible container, can match the performance of the above-mentioned pump atomizers. It should be able to spray smaller amounts without forming drops, and to produce an aerosol equal in fineness, uniformity and quantity to that produced by complicated and expensive double-piston pumps. On the other hand, it should be able to produce aerosol in quantities of up to 1 ml per stroke, albeit with less fine atomization, as is also the case with single-piston pumps. Furthermore, in order to utilize the broad performance range of the atomizer in an economical way, it should be producible as a modular construction, in such a manner that the essential performance parameters can be determined in each case by the use of interchangeable components. Finally, it should be easy to manufacture the atomizer in the form of a reclosable bottle cap. These criteria are fulfilled by an atomizer as described herein.

This arrangement permits an optimal design of the separate flow paths of the two media, so that a maximum of the kinetic energy inherent in the faster-flowing air is transmitted to the liquid. This is confirmed by typical numerical values: If the overpressure in the interior of the bottle is around 0.25 bars, the flow rate at the outflow orifice of the liquid nozzle is around 3.2 m/s, whereas the aerosol droplets are released from the mixture nozzle at a velocity of up to 60 m/s. Alternatively, larger quantities can be released at a lower velocity, so that various requirements regarding the amount and fineness of the aerosol can be met.

The application range of the atomizer can be extended by placing a vortex chamber before the liquid nozzle. This chamber is connected to the riser by means of a tangential inflow channel. In addition, the annular air chamber can also be provided with a tangential inflow channel. Here, it is advantageous to position the inflow channels in such a manner that the liquid and the air both rotate in the same direction. This increases the radial velocity of the mixture, thus widening the spray angle: The aerosol is distributed more uniformly over a larger surface.

A particularly effective construction can be obtained by incorporating the annular chamber and the mixture nozzle into an air-channeling component, and the vortex chamber and the liquid nozzle into a liquid-channeling component, and by fixing these components coaxially in a receptacle component. These components can be manufactured at low cost, e.g. of plastic, and are very easy to assemble.

The performance characteristics of the atomizer can be adapted to various purposes by combining different air-channeling and liquid-channeling components with each other.

If the distance between the components that are coaxially arranged in the cup-shaped receptacle component can be altered by means of spacers, various performance characteristics of the atomizer can be achieved with the same components.

An additional function of the atomizer can be attained by forming the components located in the receptacle component into a cylindrical group, and permitting them to rotate around their axis in such a manner that, together with the side wall of the cup-shaped receptacle component, they form a valve to close off the inflow channels. Thus, the container can be closed by simply turning the component group. In this case, it is advantageous to provide one of the components of the group with a grip means.

The receptacle component is best formed as one piece with the closure means for the container mouth. Here, for practical reasons, the spray axis should be approximately transverse to the axis of the container. This arrangement gives the inflow channels a simple, direct course into the vortex chamber and the annular chamber, thus preventing flow loses, and also making the atomizer easier to use.

Figure 2:
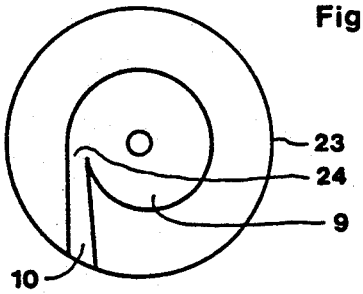
Figure 3:
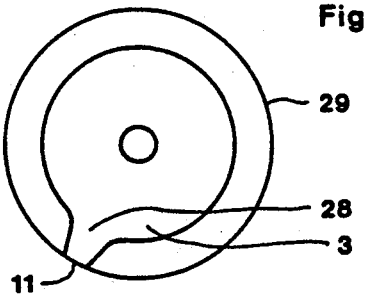
Figure 4:
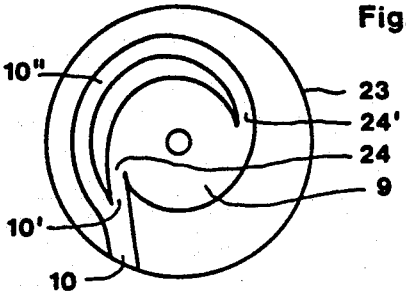
Figure 5:
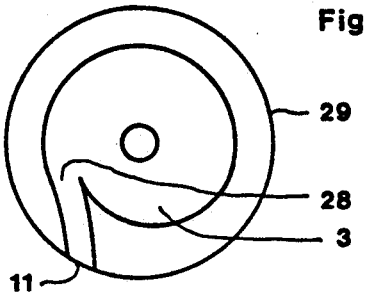
Figure 6:
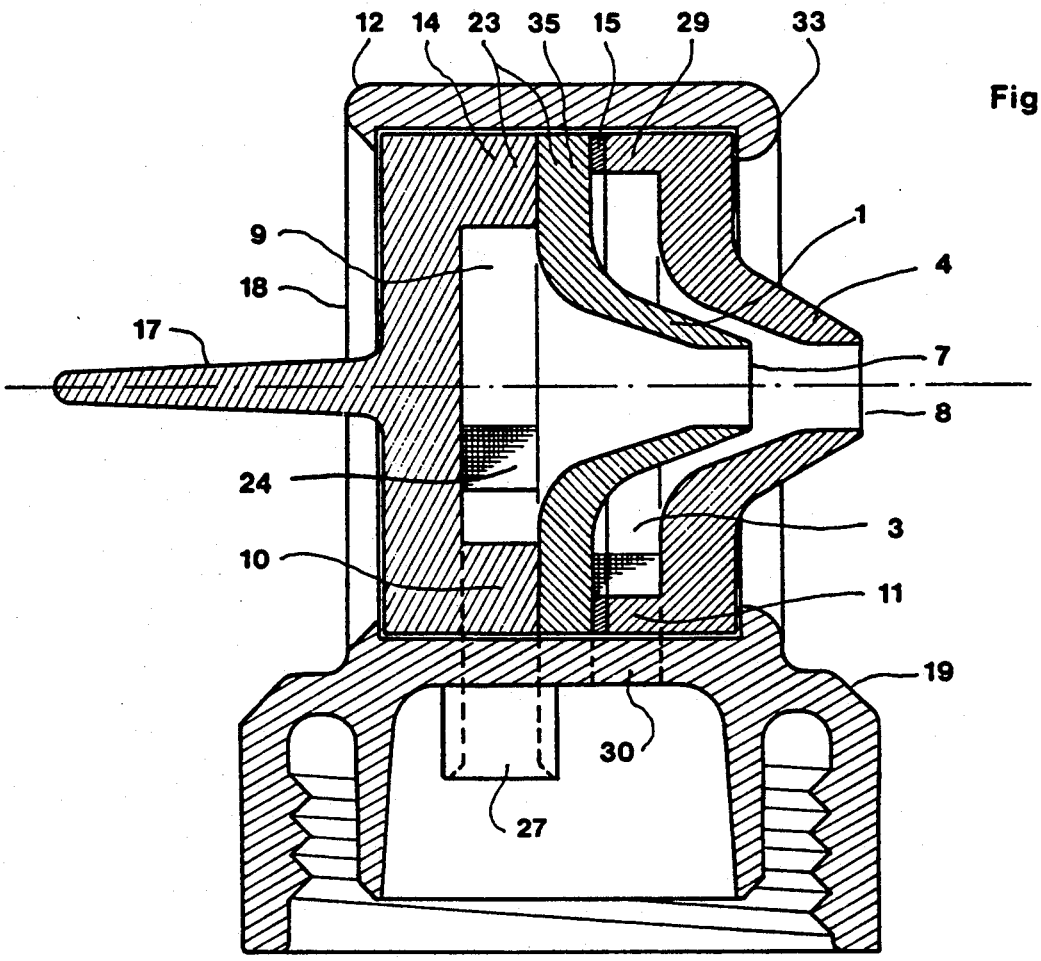
Figure 7:
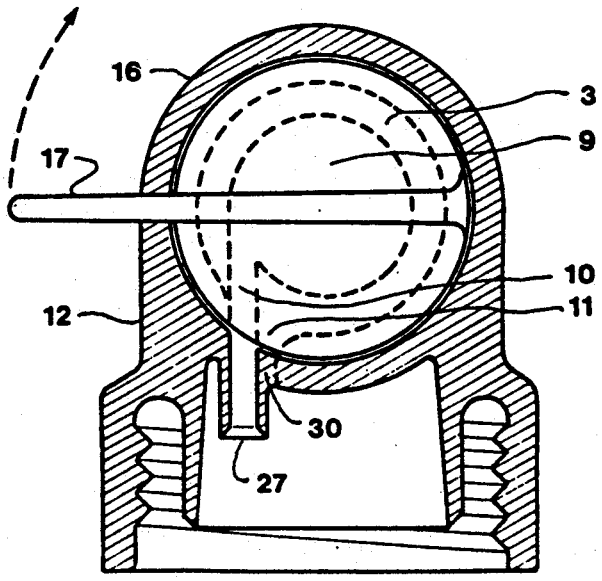

Examples of various embodiments of the invention are shown in the illustrations, and are described in greater detail below, as follows:

FIG. 1 Cross-section through an atomizer according to the invention,

FIG. 2 View of the liquid-channeling component of FIG. 1 in the direction of arrow A, FIG. 3 View of the air-channeling component of FIG. 1 in the same direction, FIG. 4 View of an alternative construction form for the liquid-channeling component, FIG. 5 View of an alternate construction form for the air-channeling component, FIG. 6 Cross-section through an alternative embodiment of an atomizer with a rotary valve, FIG. 7 Partial cross-section through another plane of the construction according to FIG. 6.

FIG. 1 shows an atomizer consisting of three components which, for example, can be manufactured of plastic material by means of injection molding. The liquid-channeling component 23 with the liquid nozzle 1 and the air-channeling component 29 with the mixture nozzle 4 are formed as cylindrical components fixed in the receptacle component 12, which is approximately cup-shaped. The receptacle component 12 is incorporated into the closure means 19, which can, for example, be formed as a screw cap with screw thread 25. This screw cap can be attached to an ordinary plastic bottle. Sealing is provided by a sleeve 26, which seals on the interior wall of the container mouth. The riser 2 is connected to a nipple 27, which connects to the vortex chamber 9 of the liquid-channeling component 23 via an inflow channel 10. The inflow channel 10 enters tangentially into the vortex chamber 9, as can be seen particularly in FIG. 2. The inflow orifice 24 of the inflow channel 10 is visible in FIG. 1.

The liquid nozzle 1 has an approximately conical inner wall 5. The liquid enters the liquid nozzle 1 via the riser 2, the nipple 27, the inflow channel 10 and the vortex chamber 9. The outer wall 6 of the liquid nozzle 1 also has a conical form, which influences the air-flow parameters, as described below.

The mixture nozzle 4 likewise has a conical inner wall 5'. The liquid-channeling component 23 abuts the air-channeling component 29 which, together with the outer wall 6 of the liquid nozzle, forms an annular chamber 3 which surrounds the liquid nozzle 1. An inflow channel 11 leads to the annular chamber 3, said channel being connected with the air space over the liquid in the container via an air orifice 30. As FIG. 3 shows, in this embodiment the inflow channel 11 leads radially into the annular chamber 3, whereby the inflow orifice 28 is visible in FIG. 1.

The liquid-channeling component 23 and the air-channeling component 29 are located on a common axis 20, which is also the spray axis. In the direction of flow, the orifice 7 of the liquid nozzle is retracted relative to orifice 8 of the mixture nozzle. The liquid nozzle 1 extends into the mixture nozzle 4 in such a manner that a conical annular channel 34 is formed, said channel leading from the annular chamber 3 into the mixture nozzle 4.

The liquid-channeling component 23 and the air-channeling component 29 can, for example, be snapped or welded to fasten them into the cup-shaped receptacle component 12. In order to permit reclosure of the atomizer, a cover 31, for example, can be attached movably with a film hinge 32 to the closure means 19. The cover 31 has a stopper 22 which plugs the orifice 8 of the mixture nozzle when the lid is raised, and thus closes the orifice. Instead of the stopper, a cap can be used.

FIG. 4 shows an alternative embodiment, in which the inflow channel 10 is divided into two separate channels 10' and 10''. They also connect tangentially with the diametrically opposed inflow orifices 24 and 24' in the vortex chamber 9. FIG. 5 shows an air-inflow channel 11 which likewise connects tangentially, instead of radially, to the annular chamber 3.

In the alternative embodiment shown in FIG. 6, the shape and position of the liquid nozzle 1 and the mixture nozzle 4 are similar to those shown in FIG. 1. In FIG. 6, however, the liquid-channeling component 23 consists of two elements: the chamber part 14 and the nozzle part 35. The vortex chamber 9 is formed mainly by the chamber part 14. Instead of the rear wall 13 as shown in FIG. 1, the receptacle component 12 is provided with an orifice 18, through which a grip means 17 extends, the latter being fixed to the chamber part 14. All parts in the receptacle component are cylindrical, and are connected into one unit. The entire unit is retained in the receptacle component in such a manner that it can be rotated.

As is shown particularly in FIG. 7, the components 23 and 29, together with the side wall 16 of the receptacle component 12, form a valve for the inflow channels 10 and 11. To close the inflow channels, the entire unit is rotated with the grip means 17 until the side wall 16 completely closes the channels. In the same way, the cross-section of the inflow channels can also be merely reduced, so that a lesser amount of liquid is allowed to flow out. If the receptacle component 12 is made of a flexible plastic material, the rotatable unit can be snapped into the receptacle component to abut shoulder 33.

FIG. 6 shows a spacer 15 that is located between the liquid-channeling component 23 and the air-channeling component 29 in order to increase the axial distance. Such spacers make it possible to standardize the components, so that the same components 23 and 29 can be used to achieve different spray characteristics.

These different spray characteristics can be understood with reference to FIG. 1 and FIG. 6, which are drawn to the same scale of approximately 10:1. Obviously the liquid flow is influenced primarily by the design of the inflow channel 10, the inflow orifice 24, the vortex chamber 9, and the inner wall 5 of the liquid nozzle 1. Analogously, air flow is influenced by the design of the inflow channel 11, the inflow orifice 28, the annular chamber 3, and the annular channel 34, and also by the relative cross-section sizes. Thus, FIGS. 1 and 6 can be compared in regard to these features.

FIG. 1 shows an atomizer for drop-free discharge of a relatively small amount of liquid in the form of a fine aerosol. In this application (e.g. for cosmetic products) a plastic bottle with a volume of approximately 200 ml and a liquid volume per stroke of 0.1 to 0.15 ml would be customary. This quantity would have to be discharged within approximately 0.25 seconds to achieve a flow velocity sufficient for fine atomization. During this time, an average overpressure of 0.2 to 0.3 bars would be required for liquid densities of around 1 g/ml. Thus, the flow cross-sections for both media are comparatively small.

The diameter of the vortex chamber 9 is large relative to the diameter of the orifice 7 of the liquid nozzle 1. This produces a steep pressure gradient between the inflow orifice 24 and the orifice 7, said gradient accelerating the liquid flow within the vortex chamber. At the same time, the amount of liquid discharged is reduced by the relatively high counterpressure at the inflow orifice 24.

The diameter of the annular chamber 3 is larger than that of the orifice 8 of the mixture nozzle 4. This decelerates the air flow in the annular chamber 3, thus increasing the air pressure, so that flow though the conical annular channel 34 is essentially symmetrical. The conical angle of the outer wall 6 of the liquid nozzle 1 is equal to or less than that of the inner wall 5' of the mixture nozzle 4, so that the cross-section area of the annular channel 34 constantly decreases in the direction of flow, thus accelerating the air flow in the annular channel 34.

In contrast to FIG. 1, FIG. 6 shows an atomizer for coarse atomization of approximately 1.2 ml of liquid per stroke. For such applications (e.g. cleaning agents), bottle volumes of up to 500 ml are customary. Here the flow cross-sections are larger, flow velocities lower, and the average overpressure is only about 0.1 bars. In comparison with FIG. 1, the diameter of the vortex chamber 9 is less large relative to that of the orifice 7, since a higher counterpressure at the inflow orifice 24 would reduce the amount of liquid. For the other relative dimensions, the description given for FIG. 1 also applies here.

In all embodiments of the atomizer, the two media flow together at their maximum velocities in the plane of the orifice 7. Because of the vortex chamber 9, the liquid is expelled from the orifice 7 as a hollow conical stream; this enhances the mixing of the two media. The two media are accelerated, at first singly and then jointly, with a corresponding pressure drop, until they reach the plane of the orifice 8 of the mixture nozzle 4. The further the plane of orifice 7 is retracted from the plane of orifice 8, the greater the counterpressure at orifice 7 of the liquid nozzle 1. In this manner, the performance characteristics of the atomizer can be changed by altering the relative nozzle position, without otherwise altering the design. It has already been pointed out that this can best be done economically using spacers. Obviously this is also possible, e.g. by providing the components in the receptacle component 12 with a suitable thread, so that the relative position of the two nozzles can be varied.

For practically all applications, containers with larger volumes customarily expel larger doses. As previously explained, the latter require larger flow cross-sections. Therefore, the flow cross-sections in the different embodiments of the atomizer are large enough to permit rapid refilling of the container air space. Thus, repeated rapid actuation of the atomizer is possible without the necessity of additional air-inlet valves.

We claim:

1. Atomizer for attachment to a compressible container with a liquid nozzle (1) for the liquid to be atomized and with a riser (2) extending into the interior of the container, a vortex chamber (9) connected with the riser (2) by means of a tangential inflow channel (10), the vortex chamber leading to the liquid nozzle (1), and also with an annular chamber (3) around the liquid nozzle, the chamber being connected with the air space in the container above the liquid, the annular chamber (3) opening into a mixture nozzle (4) located on the same axis as the liquid nozzle (1), the liquid nozzle (1) and the mixture nozzle (4) having approximately conical interior walls (5, 5'), and the liquid nozzle (1) having an approximately conical exterior wall (6), and extending into the mixture nozzle in such a manner that the annular chamber (3) opens into the mixture nozzle (4) through an annular conical ring channel (34), and that the orifice (7) of the liquid nozzle lies on a level which is retracted in the direction of flow from the orifice (8) of the mixture nozzle, the annular chamber (3) and the mixture nozzle (4) being incorporated in an air-channeling component (29), the vortex chamber (9) and the liquid nozzle (1) being incorporated in a liquid-channeling component (23), the liquid-channeling component (23) and the air-channeling component (29) being successively mounted coaxially in a receptacle component (12), the components (1, 4, 14) located in the receptacle component (12) being cylindrical, and being rotatable in such a manner that they form, together with the side wall (16) of the receptacle component, a valve for narrowing or closing the inflow channels (10, 11).

2. Atomizer according to claim 1, wherein one of the components located in the receptacle component (12) is provided with a grip means (17) for actuating the valve.

* * * * *